US012479616B2

(12) United States Patent
Smeets et al.

(10) Patent No.: US 12,479,616 B2
(45) Date of Patent: Nov. 25, 2025

(54) METHOD FOR OPERATING A PACKAGING MACHINE AND A PACKAGING MACHINE

(71) Applicant: Syntegon Packaging Solutions B.V, Weert (NL)

(72) Inventors: Roger Smeets, Posterholt (NL); Tom Kok, Weert (NL)

(73) Assignee: Syntegon Packaging Solutions B.V., Weert (NL)

( * ) Notice: Subject to any disclaimer, the term of this patent is extended or adjusted under 35 U.S.C. 154(b) by 0 days.

(21) Appl. No.: 18/547,223

(22) PCT Filed: Sep. 21, 2022

(86) PCT No.: PCT/EP2022/076190

§ 371 (c)(1),
(2) Date: Aug. 21, 2023

(87) PCT Pub. No.: WO2023/046733

PCT Pub. Date: Mar. 30, 2023

(65) Prior Publication Data

US 2024/0124177 A1 Apr. 18, 2024

(30) Foreign Application Priority Data

Sep. 21, 2021 (DE) ..... 10 2021 124 429.3

(51) Int. Cl.
*B65B 57/02* (2006.01)
*B65B 59/00* (2006.01)
(Continued)

(52) U.S. Cl.
CPC ..... *B65B 57/02* (2013.01); *B65B 59/003* (2019.05); *B65B 61/005* (2013.01); *B65B 61/025* (2013.01); *B65B 2210/04* (2013.01)

(58) Field of Classification Search
None
See application file for complete search history.

(56) References Cited

U.S. PATENT DOCUMENTS 6,854,242 B2 * 2/2005 Stork ..... B65B 53/02 53/53
9,132,971 B2 * 9/2015 Overly ..... B65B 35/50
(Continued)

FOREIGN PATENT DOCUMENTS

EP 3859465 A1 8/2021
JP H0632325 A 2/1994
(Continued)

OTHER PUBLICATIONS

International Search Report for Application No. PCT/EP2022/076190 dated Feb. 10, 2023 (2 pages).
(Continued)

*Primary Examiner* — Toan H Vu
(74) *Attorney, Agent, or Firm* — Michael Best & Friedrich LLP

(57) ABSTRACT

Method for operating a packaging machine, in particular a form, fill and seal machine, wherein in at least one method step the packaging machine processes a film material (14) for packing a product according to at least one processing instruction, wherein the at least one processing instruction is derived from a user input via an interface device (16) of the packaging machine and wherein the interface device (16) displays an image (18) of the film material. It is proposed that in at least one method step a modification (20) of the displayed image (18) by a user input via the interface device (16) is converted to the at least one processing instruction.

16 Claims, 3 Drawing Sheets

(51) Int. Cl.
*B65B 61/00* (2006.01)
*B65B 61/02* (2006.01)

(56) References Cited

U.S. PATENT DOCUMENTS

| | | | | |
|---|---|---|---|---|
| 10,926,507 | B2 * | 2/2021 | Wetsch | B65B 57/145 |
| 2008/0091299 | A1 | 4/2008 | Yoshikawa et al. | |
| 2013/0280463 | A1 * | 10/2013 | On | B44C 1/105 428/38 |
| 2015/0096267 | A1 | 4/2015 | Svensson | |
| 2015/0286900 | A1 | 10/2015 | Barros | |
| 2016/0162222 | A1 * | 6/2016 | De Boer | G06F 3/1256 358/1.15 |
| 2020/0041978 | A1 | 2/2020 | Hofmann et al. | |
| 2021/0086927 | A1 * | 3/2021 | Lancaster, III | B65B 11/045 |

FOREIGN PATENT DOCUMENTS

| | | | |
|---|---|---|---|
| JP | H10129629 | A | 5/1998 |
| JP | 2010235159 | A | 10/2010 |
| JP | 2014156274 | A | 8/2014 |
| JP | 2021155082 | A | 10/2021 |
| WO | 2020241224 | | 12/2020 |

OTHER PUBLICATIONS

Japanese Patent Office Action for Application No. 2023564520 dated Dec. 11, 2024 (15 pages including English translation).
German Patent Office Action for Application No. 102021124429.3 dated Jun. 17, 2022 (11 pages including English translation).
European Patent Office Action for Application No. 22792801.7 dated Jul. 10, 2024 (4 pages).
Japanese Patent Office Action for Application No. 2023564520 dated Aug. 7, 2024 (22 pages including English translation).

* cited by examiner

METHOD FOR OPERATING A PACKAGING MACHINE AND A PACKAGING MACHINE

BACKGROUND

A method for operating a packaging machine, in particular a form, fill and seal machine, wherein in at least one method step the packaging machine processes a film material for packing a product according to at least one processing instruction, is already known. The at least one processing instruction is derived from a user input via an interface device of the packaging machine. The interface device displays an image of the film material.

US 2015/286900 A1, WO 2020/241224 A1 and US 2020/041978 A1 disclose methods for operating a packaging machine, in particular a form, fill and seal machine, wherein in at least one method step the packaging machine processes a film material for packing a product according to at least one processing instruction.

SUMMARY

The invention is based on a method for operating a packaging machine, in particular a form, fill and seal machine, wherein in at least one method step the packaging machine processes a film material for packing a product according to at least one processing instruction, wherein the at least one processing instruction is derived from a user input via an interface device of the packaging machine and wherein the interface device displays an image of the film material.

It is proposed that in at least one method step of the method a modification of the displayed image by a user input via the interface device is converted to the at least one processing instruction. The interface devices can give the processing instruction to the packaging machine, while the packaging machine is processing the film material, and/or sets-up the packaging machine with the processing instruction in advance for processing the film material afterwards. Preferably, the processing instruction is generated for a packaging machine that is built as a vertical form, film and seal machine or as a horizontal form, film and seal machine. Parallel to the method or after the method has been executed the packaging machine preferably packs the product for packing with the film material. In particular the packaging machine forms a container, in particular a bag, out of the film material for the product and/or wraps the film material around the product. The method is in particular provided to instruct the packaging machine how to process the film material, in particular before packing the product with the film material. Preferably, the processing instruction instruct the packaging machine to add a new feature to the film material. For example, the processing instruction instruct the packaging machine to imprint the film material. For example, the processing instruction instruct the packaging machine to affix a label to the film material. For example, the processing instruction instruct the packaging machine to add a punch hole or cut-out to the film material. The processing instruction can be a simple execute-command for a predefined function of the packaging machine and or comprise detailed information about how the added feature should be added. In particular the processing instruction can comprise an instruction regarding a position and/or alignment of the feature to be added to the film material. For example, the processing instruction can comprise an instruction regarding a font style, a printing colour, a contour of the punch hole, e.g. a circle, a euro-slot, a triangle slot, or the like. For example, the processing instruction instructs the packaging machine, where or when to cut-off the film material, in particular such that the cut-off piece of the film material is big enough to pack on unit of the product. The processing instruction is preferably stored in the interface device and/or in a control system of the packaging machine. In particular, the interface device and/or the control system put the processing instruction, in particular several processing instructions, defined by the user input, and optional standard processing instructions stored in the interface device and/or the control system, together to build a recipe for the packaging machine. Preferably, the processing instruction is only executed by the packaging machine, when the packaging machine receives an additional trigger signal that is different from the processing instruction. The trigger signal is for example given by a start-button of the packaging machine, an internal clock of the control system and/or a sensor unit of the packaging machine.

Preferably, the film material is stored on a reel that is suspended at or within the packaging machine until processed by the packaging machine. Alternatively, the film material is stored as a stack of pre-cut sheets. In an unreeled state of the film material, the film material comprises preferentially a maximum longitudinal extension, a width and a maximum material thickness, which are mutual perpendicular to each other. Preferably the maximum longitudinal extension is larger, in particular more than 10 times larger, than the width. Preferably the width is larger, in particular more than 10 times larger, than the maximum material thickness. The material thickness is preferably thinner than 5 mm, more preferably thinner than 2 mm, even more preferably thinner than 1 mm, optionally thinner than 0.5 mm. In some embodiments, the film material can have a material thickness of less than 0.1 mm. The material thickness is preferably thicker than 0.025 mm. The film material can be single layered or multi-layered. The film material and/or at least one layer of the film material can be made from paper, a plastic, for example polypropylene, polyester and/or polyethylene, a textile and/or a metal. In particular the film material is made from a compound material, in particular a laminate. Optionally, the film material is made from renewable raw material and/or is bio-degradable. The film material and/or at least one layer of the film material can be a solid, a web, a mesh, a netting or the like. The film material comprises preferably an outside surface and an inside surface, which are essentially parallel to the maximum longitudinal extension and to the width of the film material. The expression "essentially parallel" should in particular be understood as an alignment of a direction with respect to a reference direction, in particular a plane, wherein the direction deviates from the reference direction by less than 8°, preferentially by less than 5° and even more preferentially by less than 2°. The inside surface is preferentially configured to face, in particular to be in direct contact with, the product in a packed state of the product with the film material. For example, the inside surface of the film material may be made from or coated with a food safe material. In a packed state of the product for packing, the outside surface is preferentially configured to face away from the product for packing and in particular towards an environment.

The interface device comprises at least one display to output the image of the film material. The interface device comprises at least one input element to acquire a modification to the image from a user. Optionally, the input element can be integrated into the display, i.e. the display is a touchscreen or the display comprises one or more buttons to allow a user to modify the image. Alternatively, the input element can be a keyboard, a mouse, a wired glove, a camera system to recognise gestures or eye movement, or any other input device deemed useful by a person skilled in the art. The interface device comprises a processor, in particular a central processing unit, a memory, an input interface, an output interface, further electronical components, an operating program, control routines and/or calculation routines. The interface device may be part of the control system of the packaging machine or a standalone device configured to communicate with the control system of the packaging machine.

The image of the film material displayed by the interface device can be a picture of the film material taken by a camera or a drawing of the film material. Preferably, the image shows the film material in a state before processing by the packaging machine and/or in a partly processed state. Preferentially, the image shows the film material over a whole width of the film material in a direction perpendicular to a transportation direction of the film material within the packaging machine. In particular, the image shows a preprint and/or other features of the film material that are/is bestowed upon the film material before the film material is put into the packaging machine. Optionally, the image shows at least one feature of the film material, that is bestowed upon the film material by the packaging machine, in particular independently from the user input. Preferably, the interface device offers predefined modifications of the film material, which are possible to be processed by the packaging machine. The interface device can offer the predefined modifications by allowing the user to choose freely, for example from a graphical menu displayed on the display, or by querying the user if and/or how a specific modification should be made in a fixed order, in particular in order to keep the number of items displayed at the display in addition to the image to a minimum. A modification of the image can, for example, comprise adding a new feature, such as a label, a print, a punch hole, a cut out or the like, to the image of the film material, define a position for that new feature and/or define an alignment of that new feature. A modification of the image can, for example, comprise to define a film spot of the film material as a reference, to define a length of a section of the film material, which is to be processed to pack one unit of the product. The interface device interprets for example a free-hand drawing of a cursor upon the image as a modification. The interface device interprets for example clicking into the image to define a geometrical feature point, such as a corner, a centre point of a predefined geometrical structure, as a modification to the image. The interface device interprets for example a predefined modification, that was dragged and dropped onto the image as a modification. For example, the interface device interprets an alpha-numerical input, in particular key-words, as a modification. Preferably, the interface device displays the image together with the modifications, so as to give the user direct feedback about the modification made by via the user input.

The interface device, in particular the processor of the interface device, preferably evaluates in at least one method step at least one modification added by the user to the image. In particular, the interface device infers the type of modification, the relative position of the modification to a reference point and/or the alignment of the modification from the modified image. The term "modified image" refers, in particular, to a composite image composed of the image and the modification, in particular all modifications, by the user input. The interface device can handle, in particular save, the image and the modification(s) separately, e.g. in different files, in different layers of a file, in separate memory sections of the interface device, or inseparably, i.e. the interface device partly overwrites the image with the modification. Preferably, the interface device interprets the modification to the image to create at least one processing instruction for the packaging machine. In particular, the interface device transforms a graphical information contained in the modified image into the processing instruction, i.e. into a command understandable by the packaging machine, in particular the control system. The interface device can send the processing instruction directly to a processing station of the packaging machine or to a central, in particular the above mentioned, control system of the packaging machine.

With a method according to the invention processing instructions to the packaging machine can be generated with an advantageous What-you-See-is-What-You-Get (WYSIWYG) approach. In particular, details of the film material, in particular a preprint of the film material, does not have to be known beforehand in an explicit, that is in a numerical manner. In particular an exact measuring of the film material beforehand can be omitted. Furthermore, when the packaging machine is reconfigured to a new film material and/or new product, a number of test runs of the packaging machine, whether the input processing instruction lead to the desired outcome, can be kept advantageously low. In particular, a waste of film material and/or the product for packaging can be kept advantageously low.

Furthermore, it is proposed, that in at least one method step of the method the image is taken by a sensor unit of the packaging machine. The senor unit comprises preferably at least one optical camera to take a picture of the film material, in particular while the film material is inside the packaging machine. The sensor unit preferably sends the picture taken of the film material to the interface device, which displays the picture as the image of the film material on the display. Alternatively, the sensor unit comprises a camera with a sensitivity maximum in the infrared or ultraviolet spectrum. Preferably, the camera is built as an active-pixel sensor, as a charged-coupled device sensor, as a contact image sensor or the like. The camera can have a one-dimensional or a two-dimensional sensor-array to take the picture line by line or as a whole, respectively. The sensor unit takes the picture preferentially before forming the film material to a container. The senor unit, in particular, the camera, is preferably arranged behind at least one of the processing stations of the packaging machine, in particular behind those processing stations that can be instructed via the interface device, in particular to monitor if a modification made to the image results in a correct processing of the film material by at least one of the processing stations of the packaging machine. The terms "behind/before" should in particular be understood as behind/before with respect to the transportation direction of the film material within the packaging machine. Preferably, the processing stations are stopped, in order to take the picture of the film material with the camera in an unprocessed state of the film material. Alternatively or additionally, the senor unit comprises a further camera, that is arranged before the processing stations, in particular before those processing stations that can be instructed via the interface device. In some embodiments, the sensor unit, in particular the further camera, is arranged behind a splicing station of the packaging machine, in which two batches of the film material are spliced. With a method according to the invention the image is advantageously similar to the film material within the packaging machine. In particular, the image represents the film material in exactly that way as the packaging machine sees the film material during a processing stage of the method. The image can be taken advantageously easy, in particular with no special measures in order to be compatible with the packaging machine, e.g. taking a picture from a certain angle, transform a perspective afterwards, correct a brightness of the picture, correct a contrast of the picture or the like. Furthermore, an absolute position of the film material within the packaging machine can be inferred, such that a risk of a lateral displacement of added feature to the film material in accordance with the processing instruction can be kept advantageously low.

In addition, it is proposed that in at least one method step of the method the image is taken or generated by an external device and uploaded to the packaging machine. For example, the external device can be an external sensor unit, in particular a stand-alone camera. In particular, the user takes a picture with the external device and uploads it to the interface device as the image to be displayed. Alternatively, the image is provided by a provider of the film material and the image is uploaded to the device from an external memory, such as a universal serial bus-stick or a memory card or the like. Alternatively, the interface device queries the image via a public or private data network, in particular the internet, from a server of the provider of the film material. In an alternative embodiment, the external device is an external computer configured to provide design software. In particular, the user or a provider of the film material draws a design of the film material on the external device and uploads the design of the film material to the interface device as the image to be displayed. In some embodiments, in particular for packaging machines that comprise a sensor unit with sensor elements dedicated to a single feature in a small area of the film material, the image comprises patches of sensor data from the senor unit inserted into a design of the film material uploaded from an external device. With a method according to the invention the method can be used with an advantageously high amount of different packaging machines, in particular also with packaging machines that do not comprise a sensor unit capable of taking a picture of the whole film material.

It is further proposed that in at least one method step of the method the interface device extracts a coordinate of the modification of the image with respect to a, in particular the above-mentioned, film spot of the film material. Preferably, the interface device is provided to define a feature pattern for the film material in accordance with the user input, i.e. the modification of the image. The feature pattern is in particular a set of different types of features of the film material, that is provided to repeat itself along the transportation direction. Preferably, within each instance of the feature pattern along the transportation direction an arrangement of the features belonging to the feature pattern is identical. A concrete embodiment of each feature belonging to the same type of feature of the film material can be identical between instances of the feature pattern, e.g. a product identification, a food labelling or the like, or vary between the instances of the feature pattern, e.g. a serial number, a date/time of packing or the like. Preferably, the feature pattern comprises the film spot as a feature. Preferentially, the interface device offers the option to define the film spot or actively queries the user to define the film spot. In an embodiment, in which the senor unit takes a picture over essentially the whole width of the film material, independently whether this picture is used as the image or not, the interface device allows to mark a region on the image which is used as film spot. Optionally, the interface device, in particular the processor, checks whether the marked region comprises a unique pattern, that is recognisable by the packaging machine. The interface device preferably queries the user, additionally to marking the region, what kind of unique pattern the region comprises. The film spot may be a feature on its own, e.g. a small dot, strip or the like, or alternatively a distinct graphical feature of a preprint of the film material is used as the film spot, e.g. a course of a curve, a colour change or the like. Preferably, the packaging machine monitors the film material to find the film spot and synchronises thereby a transportation velocity of the film material and the operation of the processing stations, in particular to faithfully reproduce the feature pattern. The interface device preferentially analyses the modified image to infer a distance parallel to the transportation direction of a feature of the feature pattern, which is to be added to the film material, relative to the film spot. The interface device sends the coordinates of the feature to be added, i.e. the distances to the film spot, to the packaging machine as processing instruction, in particular such that the packaging machine is able to calculate the correct delay time between the detection of the film spot and a processing time of the film material by one of the processing stations and activates the processing station accordingly. In some embodiments, in which the interface device has access to the transportation velocity of the film material, e.g. by a rotational encoder or a laser surface velocimeter of the senor unit, the interface device can calculate the time delay on its own and sends the time delay as processing instruction directly to the processing stations of the packaging machine. Optionally, the interface device infers, in particular additionally to the distance parallel to the transportation direction, a lateral distance perpendicular to the transportation direction between the feature to be added and the film spot. Preferably, the interfaces device sends the lateral distance to the packaging machine, in particular to one of the processing stations of the packaging machine, in order to automatically reconfigure the processing station, i.e. readjust a lateral position perpendicular to the transportation direction of a processing tool of the processing station. With a method according to the invention a desired relative position of the features can be extracted from the image automatically and in particular advantageously precisely.

Additionally, it is proposed, that in at least one method step of the method the interface device displays a preview of the film material comprising the image and the modification as interpreted by the interface device. Preferentially, the display displays the image with a graphical representation of the modification added by the user to the image. The graphical representation may be specific, in particular photo-realistic, by choosing the modification from a database of possible modifications or generic, such as a simple geometric form, e.g. a rectangle, a circle, a triangle, or the like. Different modification may be represented by different colours, different line styles, different fillings or the like. The display can represent the modification in a raw version and/or in an interpreted version. A raw version of the modification comprises, for example, an exact course of a pointer on the display, when the users adds the modification to the image. An interpreted version can comprise snapping the modification to a grid, smoothing a course of a pointer on the display, fade out parts of the image, that are to be cut off, or so on. With a method according to the invention a risk that a user input being interpreted wrongly is further processed to the processing instruction can be kept advantageously low.

Moreover, it is proposed, that in at least one method step of the method a cutting position or a target length added to the image is extracted from the image and forwarded as the processing instruction to a cutting station of the packaging machine. Preferentially, the film material is cut by the cutting station, such that a cut-off segment packs one unit of the product. In particular the cut-off segment comprises one instance of the feature pattern. The film material is fed to the cutting station in particular along the transportation direction. The interface device offers the user to define the cutting position, by modifying the displayed image, e.g. by drawing a line perpendicular to the transportation direction, where to cut. Alternatively or additionally, the interface device queries the user to input or mark the target length of the segment of the film material to be cut-off for packaging the product. The target length is in particular a maximum length of a cut-off segment of the film material parallel to the transportation direction. With a method according to the invention the cutting position of the film material can be defined graphically. In particular, a risk of the packaging machine cutting the film material wrongly, can be kept advantageously low.

Furthermore, it is proposed that in at least one method step of the method at least one label, at least one punch hole and/or at least one printing added as modification to the image is added to the film material by the packaging machine. In particular, the interface device sets flags for different modifications added to the image by the user. The flags can be queried from the user, e.g. individually for each modification and/or by offering predefined modifications, or be set automatically, e.g. in dependence of a timely order, in which the modifications are done. In some embodiments the interface device is set up via machine learning to recognize the type of modification the user added to the image. Alternatively, the interface device compares the modification with a database of known modifications to identify the modification added by the user. When a modification is flagged as a punch hole, the interface device generates a processing instruction to the packaging machine, in particular a punching station of the packaging machine, comprising at least one of the following information, extracted from the modified image: a position of the punching hole to be added to the film material, in particular with respect to the film spot, a diameter of the punching hole to be added to the film material, and/or an amount of punching holes to be added to the film material. When a modification is flagged as a printing, the interface device generates a processing instruction to the packaging machine, in particular a printing station of the packaging machine, comprising at least one of the following information, extracted from the modified image: a position of the printing to be added to the film material, in particular with respect to the film spot, an alignment of the printing to be added to the film material, in particular a text alignment of the printing, and/or a printing style, e.g. font size, colour etc., of the printing to be added. When a modification is flagged as a label, the interface device generates a processing instruction to the packaging machine, in particular a label station of the packaging machine, comprising at least one of the following information, extracted from the modified image: a position of the label to be added to the film material, in particular with respect to the film spot, an alignment of the label to be added to the film material, and/or which label to add to the film material. With a method according to the invention a label, a punch hole and/or a printing of the film material can be defined graphically. In particular, a risk of a displacement of this feature relative to each other and/or a risk of a displacement along the transportation direction can be kept advantageously low.

In addition, it is proposed that in at least one method step of the method a picture of the at least partly processed film material is compared to the image. The at least partly processed film has in particular been processed by at least one processing station of the packaging machine, for example the at least partly processed film material comprises a label, a punch hole, a printing or the like added by the packaging machine. Preferably, the picture is taken by the sensor unit, in particular by the already mentioned camera, and sent to the interface device. Preferably, the picture to compare to the image is taken before the film material is formed into the container. Alternatively, the picture is taken after the container is formed, in particular after the container is filled and sealed. The interface device preferentially compares the image modified by the user with the picture to infer any deviations of the at least partly processed film material from the modified image. For example, the interface device checks specifically, whether the film material and the features added to the film material by the packaging machine show a lateral shift transverse to the transportation direction with respect to a lateral position of the modifications on the image. If the features added to the film material show a lateral shift compared to the modified image, the interface device sent a processing instruction to the packaging machine and/or the user to cause a correction of a lateral position of the film material and/or a processing tool of at least one of the processing stations, travers to the transportation direction. Optionally, the interface device outputs the picture of the partly processed film, such as to show the image and the picture of the film material, wherein the picture and the image can for example be presented alternatively, side-by-side, semi-transparent and overlapping or the like. With a method according to the invention an advantageously early feedback can be given, whether the processing instruction inferred from the image, lead to the desired result. In particular, an automatic correction instruction can be generated advantageously early by the interface device.

Additionally, it is proposed that in at least one method step of the method an identification feature, in particular a bar code, of the film material is read, in order to load the image corresponding to the film material from a database. Preferably, the sensor unit, in particular the camera or the further camera, takes a picture of the film material comprising the identification feature. Alternatively, the sensor unit comprises a dedicated sensor element, in particular a bar code reader, which reads the identification feature. The senor unit preferably sends the identification feature to the interface device. Preferably, the interface device is configured to evaluate a linear bar code, e.g. universal product code (UPC), European Article Number (EAN), Japanese Article Number (JAN) or the like and/or a matrix barcode, e.g. Quick response code (QR code), Data Matrix, Aztec Code, Han Xin Barcode, Dot Code or the like. Preferably, the interface device identifies the film material put into the packaging machine for processing in dependence of the identification feature. In particular, the interface identifies the product for packing from the identification feature and looks up, which film material was assigned to that product beforehand. In particular, the interface device searches the database for the identification feature. The database can be stored in the memory of the interface device or on an external device, in particular a server, with which the interface device is able to communicate via a private or public data network. The database comprises entries with the identification feature, optionally the product for packing and preferably the image of the film material, wherein the image can be a picture of the film material and/or a drawing of the film material, which was optionally already modified by a user in a previous step of the method. Preferentially, the input interface outputs the image, in particular with the previously made modifications, stored in the entry of the database associated with the identification feature on the display. If the interface device cannot find an entry for the identification feature in the database and/or no image is stored in the entry for the read identification feature in the database, the interface device preferably queries the sensor unit to take a picture of the film material to use as the image and/or the interfaces device prompts the user to provide an image of the film material taken or generated by an external device. If the interface device cannot find an entry for the identification feature in the database and/or no previously modified image is stored in the entry for the read identification feature in the database, the interface device preferably queries a user, whether he wants to add any modifications to the film material or if the film material should be processed according to standard processing instructions. With a method according to the invention an input stage of the method, in which the image is modified, and a processing stage of the method, in which the film material is processed according to the modified image, can be kept separately. In particular, the packaging machine can be kept operating for another product and/or another film material, while the image is modified. In particular, a time for a changeover between different products and film material can be kept advantageously short.

Moreover, a packaging machine, in particular a form, fill and seal machine, with an, in particular the above-mentioned, interface device to execute a method according to the invention. The packaging machine comprises preferably a bearing to mount at least one reel of film material. Preferably, the packaging machine comprises a splicing station to splice the film material from a used-up reel of film material with the film material of a new reel of film material. Optionally, the packaging machine comprises the printing station to imprint the film material. The packaging machine comprises optionally the labelling station to affix a label to the film material. Optionally, the packaging machine comprises a punching station to punch at least one hole into the film material. Preferentially, the packaging machine comprises the forming station to form a container, in particular a bag, a tubular bag, a doy pack or the like, out of the film material, wherein the container can comprise a zipper or not. In order to form the container, the forming station can be configured to fold the film material and/or to seal two or more segments of the film material. The packaging machine comprises preferentially a cutting station to cut off a piece of the film material that is big enough to pack one unit of the product. Preferentially, the packaging machine comprises a filling station to fill the container formed out of the film material with the product, in particular by means of a filling pipe. Preferentially, the packaging machine comprises a sealing station to seal the container formed out of the film material and filled with the product for packaging. Two or more of the abovementioned processing stations of the packaging machine can be combined in a single processing station to perform at least two of the above-mentioned processing steps of the film material.

The packaging machine comprises preferably a guiding unit to transport, in particular an unreeled part of, the film material towards and/or through at least one processing station of the packaging machine. The guiding unit comprises preferentially guiding elements, such as rollers, band conveyers or the like, to convey, to divert and/or to span the film material along a guiding path through the packaging machine. The packaging machine may for example comprise a printing station to imprint the film material, a labelling station to affix a label to the film material, a forming station to form a container out of the film material, a cutting station to cut off a piece of the film material that is big enough to pack one unit of the product or the like. The guiding unit is configured to transport the film material with the maximum longitudinal extension of the film material being held essentially parallel to the transportation direction. In particular, the guiding elements comprise a supporting surface to support the film material. The supporting surface of the guiding elements shows a maximum width at least essentially perpendicular to the transportation direction. The guiding unit is preferably configured to keep the maximum traverse extension of the film material essentially parallel to the maximum width of the nearest guiding element, while transporting the film material. The expression "essentially perpendicular" should in particular be understood as an alignment of a direction with respect to a reference direction, wherein the direction and the reference direction, in particular when viewed in a projection plane, enclose an angle of 90° plus or minus an optional deviation, wherein the deviation is less than 8°, preferentially less than 5°, even more preferentially less than 2°.

The guiding unit is in particular configured to transport the film material between separately designed processing stations and/or through the processing stations. Preferably, the packaging machine comprises a further transportation unit to transport the product for packing in a state packed with the film material away from the processing stations. Preferably, the packaging machine comprises the control system to synchronize an operation of the processing stations with a feed rate of the film material. A packaging machine according to the invention can be operated advantageously easy and intuitively. In particular, processing instructions for the packaging machine can be generated with an What-you-See-is-What-YouGet (WYSIWYG) approach.

The method according to the invention and/or the packaging machine according to the invention are/is herein not to be restricted to the application and implementation described above. In particular, for fulfilling a function herein described, the method according to the invention and/or the packaging machine according to the invention may comprise a number of individual elements, components, units and method steps, which differs from the number herein mentioned.

BRIEF DESCRIPTION OF THE DRAWINGS

Further advantages may be gathered from the following description of the drawings. In the drawings one exemplary embodiment of the invention is shown. The drawing, the description and the claims comprise a plurality of features in combination. The person skilled in the art will expediently also consider the features individually and will bring them together in further purposeful combinations.

The drawings show.

DETAILED DESCRIPTION

Figure 1:
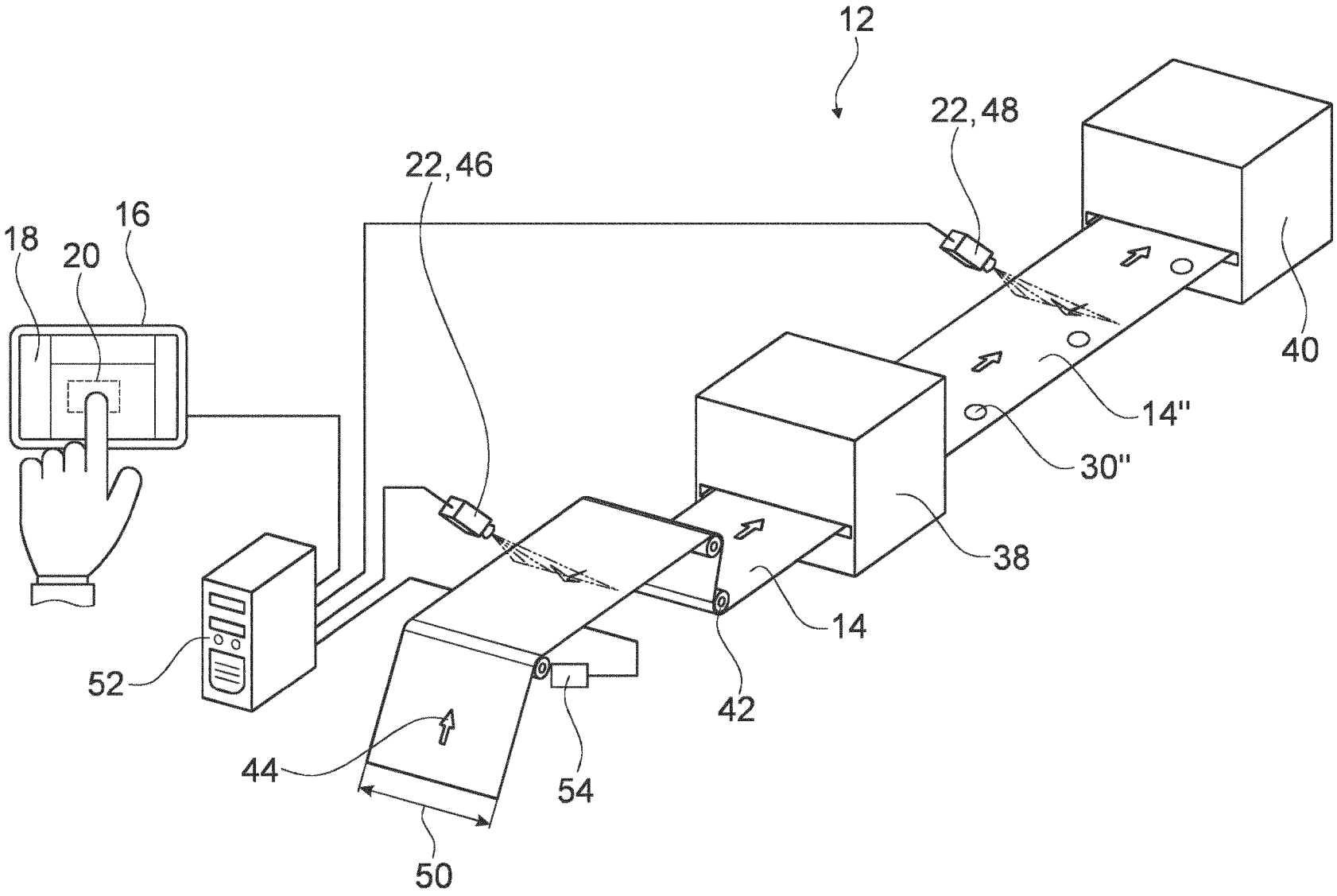
In FIG. 1 a schematic illustration of a packaging machine according to the invention, In FIG. 2 a schematic flow diagram of an input stage of the method according to the invention and In FIG. 3 a schematic flow diagram of a processing stage of the method according to the invention.

FIG. 1 shows a packaging machine 12, in particular a form, fill and seal machine.

The packaging machine 12 comprises preferably one or more processing stations 38, 40 to process a film material 14. In particular, the packaging machine 12 comprises preferably at least one packing processing station 40 to pack a product with the film material 14. The at least one packing processing station 40 is in particular configured to cut-off a piece of the film material 14, to form a container out of said piece or several pieces of the film material 14, to fill said container with a product for packaging and to seal that filled container, wherein the packaging machine 12 can be configured to execute the cutting off of the piece(s) of film material 14 before or after any of the other steps. The packing processing station 40 is optionally subdivided into smaller stations dedicated to execute a subset, in particular one, of the above-mentioned function.

Preferably, the packing machine 12 comprises at least one pre-processing station 38 to modify the film material 14, in particular before processing the film material 14 with the packing processing station 40. In particular, the packaging machine 12 can comprise any, some or all of the following pre-processing stations 38: a splicing station to splice two batches of the film material 14, a labelling station to label the film material 14, a printing station to imprint the film material 14 and/or a punching station to punch a hole into the film material 14. The packaging machine 12 comprises at least one guiding unit 42 to transport the film material 14 along a transportation direction 44, in particular from one of the processing stations 38, 40 to another. For example, the guiding unit 42 comprises rollers to convey, divert and/or span the film material 14 along the transportation direction 44.

The packaging machine 12 comprises preferably a sensor unit 22 to monitor the film material 14 transported by the packaging machine 12 along the transportation direction 44. The sensor unit 22 comprises at least one imaging unit. The imaging unit is for example, as shown here, a line scan camera 46, 48. The sensor unit 22 can comprise one or both of the shown line scan cameras 46, 48. The imaging unit is preferably arranged to monitor the film material 14 before one of the pre-processing stations 38 or between the pre-processing station(s) 38 and the at least one packing processing station 40. The imaging unit is configured to capture at least two different features of the film material 14, for example a film edge of the film material 14, an identification feature 36 of the film material 14, a film spot 24 of the film material 14 or the like (cf. FIGS. 2 and 3).

A width of a measuring area of the imaging unit, in particular the line scanning camera 46, 48, of the senor unit 22 is at least essentially as wide as a width of the film material 14 and/or as a maximum transportation width 50 of the guiding unit 42 of the packaging machine 12 in a direction transverse to the transportation direction 44. Here the width of the film material 14 coincides with the maximum transportation width 50. Depending of a unit size of the product for packing the width of the film material 14 can also be smaller than the maximum transportation width 50. The maximum transportation width 50 is in particular defined by a maximum length of a supporting surface of the rollers perpendicular to the transportation direction 44, in particular reduced by a safety margin. Preferably, the width of the measuring area of the imaging unit extends across the complete maximum transportation width 50, in particular the width of the film material 14. Optionally the width of the measuring area is wider than the maximum transportation width 50, in particular to capture additionally to the film material 14 a physical reference element indicating a position of the film material 14 with respect to the guiding unit 42, in particular a film edge location of the film material 14 with respect to the guiding unit 42. Alternatively, the sensor unit comprises one or more sensor elements, in particular with a measurement area smaller than ⅕ of the maximum transportation width 50, which are dedicated to capture a single specific feature of the film material.

The packaging machine 12 comprises an interface device 16. The interface device 16 is configured to execute a method 10, shown in FIGS. 2 and 3. Preferably, the interface device 16 comprises an output interface, in particular a display, to present at least one image 18 of the film material 14. The image 18 of the film material 14 can be a picture taken by the sensor unit 22, in particular by one of the line-scan cameras 46, 48 or a drawing of the film material 14 uploaded to the interface device 16.

Preferably, the interface device 16 outputs, in particular additional to the image 18 of the film material 14, a picture of the film material 14' in an at least partly processed state. The picture of the at least partly processed film material 14' can be a single line scan or a composition of several line scans taken by the sensor unit 22, in particular by one of the linescan cameras 46, 48 arranged behind at least one of the pre-processing stations 38. The picture of the at least partly processed film material 14' can be a static set of line scans, in particular depicting one segment of the film material 14' that is going to be processed to contain one unit of the product for packing, or a video stream of the imaging unit, that is in particular updated after each line scan. Preferentially, the imaging unit is configured to take the picture of the at least partly processed film material 14' while the film material 14, 14' is transported by the guiding unit 42, in particular while the film material 14, 14' is moving with respect to the imaging unit and the guiding unit 42. The packaging machine 12 comprises preferably at least one control system 52. The control system 52 and the interface device 16 are here shown as separate devices, that communicate with each other via a data link. In particular, the control systems 52 forwards pictures of the film material 14, 14' taken by the sensor unit 22 to the interface device 16. Preferably, the interface device 16 sends the processing instruction on how the processing stations 38, 40, in particular the pre-processing stations 38 and/or a cutting station of the packing station 40, should handle the film material 14, 14'. The control system 52 is in particular provided to synchronise the guiding unit 42 with the processing stations 38, 40. The control system 52 and/or the interface device 16 are/is configured to evaluate the picture of the at least partly processed film material 14', optionally regarding at least two different features of the film material 14, 14'. Preferably the control system 52 and/or the interface device 16 evaluates the same picture, in particular the same line scan, for at least two of the different features of the film material 14, 14'. Alternatively or additionally, the control system 52 and/or the interface device 16 evaluates at least two different pictures, in particular of the same segment of the film material 14, 14' for at least two of the different features of the film material 14, 14'. The packaging machine 12 comprises at least one velocity sensor element, in particular an encoder 54, to measure a transportation velocity of the film material 14, 14' through the measuring area of the sensor unit 22. For example, the encoder 54 is arranged at one of the rollers of the guiding unit 42, to measure a rotation velocity of the roller. In particular, the control system 52 and/or the interface device 16 determines a velocity of the film material 14, 14' for rolling off of said roller as the transportation velocity.

Figure 2:
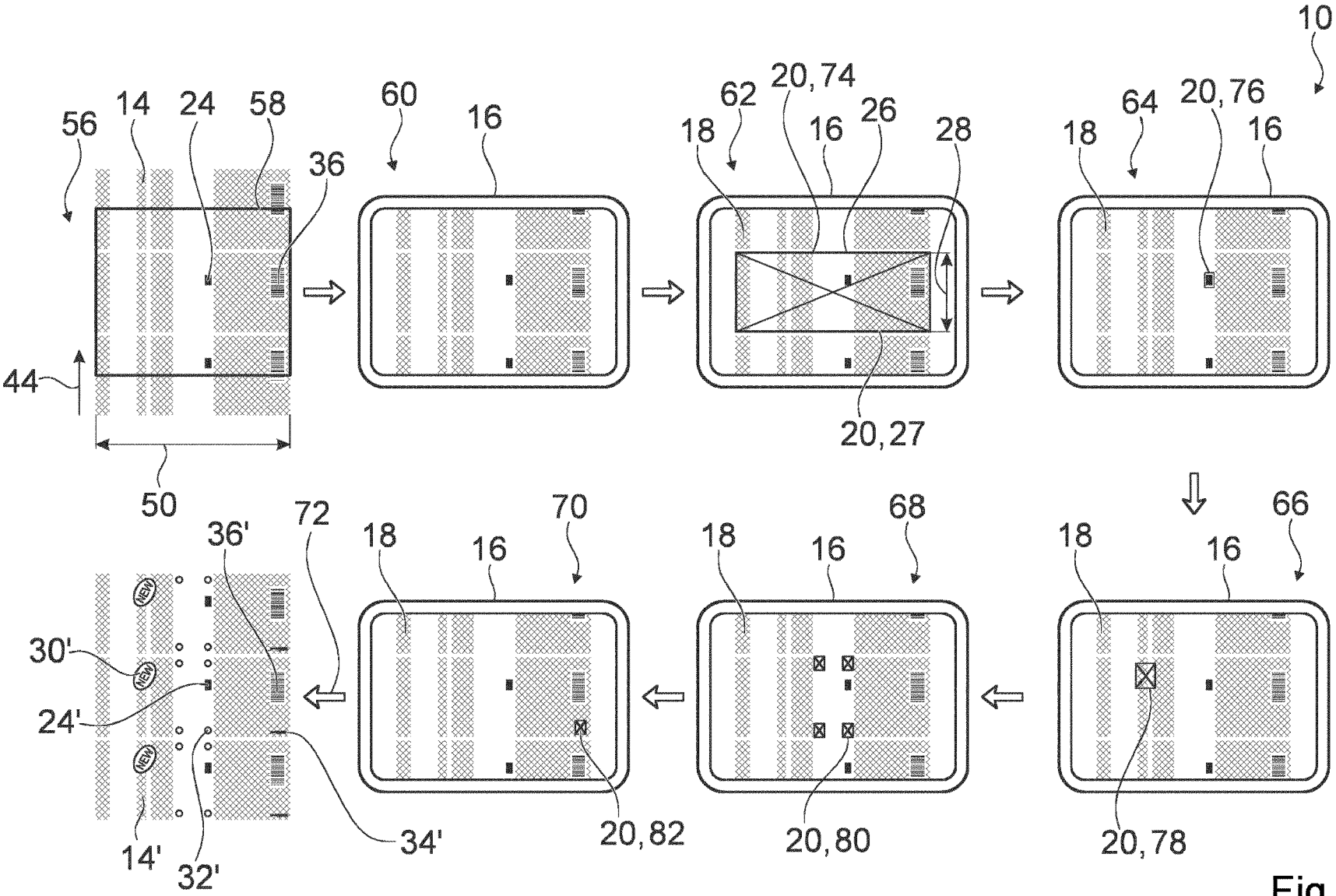

FIG. 2 shows a flow diagram of an input stage of the method 10. The at least one processing instruction is derived from a user input via the interface device 16 of the packaging machine 12. In at least one method step a modification 20 of the displayed image 18 by a user input via the interface device 16 is converted to the at least one processing instruction. The method 10 comprises in particular an input stage and a processing stage 72, shown in FIG. 3. Preferably, during the input stage of the method 10, the user modifies the image 18 of the film material 14 in order to generate the processing instruction for the processing stations 38, 40 of the packaging machine 12. Preferably, during the processing stage, the processing instruction generated during the input stage are executed by the packaging machine 12. The packaging machine 12 processes the film material 14 for packing a product according to at least one processing instruction. The input stage and the processing stage 72 of the method 10 can be separated in time or at least partly overlap with each other. For example, the image 18 and any modification 20 to the image can be prepared in advance and are uploaded to the interface device 16 or the modifications 20 to the image 18 are done on the fly, while the processing stage 72 already started, in particular to get a direct feedback, whether the modifications 20 to the image 18 are interpreted by the interface device 16 correctly and/or whether the packaging machine 12 executes the processing instruction as intended.

The method comprises in particular an image acquisition step 56. In the image acquisition step 56 the image 18 is taken by a sensor unit 22 of the packaging machine 12 and/or is taken or generated by an external device and uploaded to the packaging machine 12, in particular loaded from a database of film materials. In particular, the image represents a film section 58 of the film material 14. Preferentially, the image 18, i.e. the film section 58, extends across the whole maximum transportation width 50 perpendicular to the actual or intended transportation direction 44 of the film material 14. Preferentially, the image 18, i.e. the film section 58, extends across at least a piece of the film material that is, in a direction parallel to the actual or intended transportation direction 44 of the film material 14, big enough to pack one unit of the product.

The method 10 comprises in particular an image presentation step 60, in which the interface device 16 displays the image 18 of the film material 14. In particular, during the image presentation step 60 the interface device 16 queries, whether the user wants to modify the image 18. In this example the film material 14 already comprises a background colouring, a dot intended as film spot 24 and an identification feature 36, that are preferably added in a pre-print before the film material 14 is processed by the packaging machine 12. The method 10 comprises preferably a cutting definition step 62 for modifying the image 18. The method 10 comprises preferably a film spot definition step 64 for modifying the image 18. The method 10 comprises optionally a label definition step 66 for modifying the image 18. The method 10 comprises optionally a punch hole definition step 68 for modifying the image 18. The method 10 comprises optionally a printing definition step 70 for modifying the image 18. An order of the method steps 62, 64, 66, 68, 70 for modifying the image 18 can be fixed or chosen freely.

In the cutting definition step 62, the user can modify the image 18 by marking a position on the image 18, where the film material 18 should be cut, in order to form one container out of the cut-off piece of the film material. In particular, the interface device 16 draws a line or a rectangle or another graphical representation for cutting 74 at a cutting position 26, 27 into the image 18 in accordance with the user input. The user input may comprise marking a point or a line of the image with a pointer, drag and drop the graphical representation for cutting 74 onto the image 18, a numerical input, in particular a target length 28 of the cut-off piece of the film material or the like. The cutting position 26 or the target length 28 added to the image 18 is extracted from the image 18 by the interface device 16 and forwarded as the processing instruction to a cutting station of the packaging machine 12, in particular via the control system 52. The interface device 16 extracts a coordinate of the modification 20 of the image 18, in particular a coordinate of the cutting position 26, 27, with respect to the film spot 24 of the film material 14.

In the film spot definition step 64, the user can modify the image 18 by marking a region of the image 18, which should be interpreted as the film spot 24. In particular, the interface device 16 draws a circle, or a rectangle or another graphical representation for a film spot region 76 into the image 18 in accordance with the user input. The user input may comprise marking a point or a region of the image with a pointer, drag and drop the graphical representation for a film spot region 76 onto the image 18, a numerical input or the like. Preferably, the interface device 16 extracts the position of any other modification 20 of the image 18 with respect to, in particular a centre point of, the graphical representation of the film spot region 76. The position of film spot region is preferably extracted from the image 18 by the interface device 16 and forwarded as a trigger condition to the control system 52.

In the label definition step 66 the user can modify the image 18 by marking a position on the image 18, where a label 30' should be affixed to the film material 14'. In particular, the interface device 16 draws a circle or a rectangle or another graphical representation for a label 78 into the image 18 in accordance with the user input. The user input may comprise marking a point or a region of the image with a pointer, drag and drop the graphical representation for a label 78 onto the image 18, a numerical input, in particular a distance of the label 30 to the film spot 24 or to the film edge of the film material 14 or the like. The position of the label 30 is extracted from the image 18 by the interface device 16 and forwarded as the processing instruction to a labelling station of the packaging machine 12, in particular via the control system 52. The interface device 16 extracts a coordinate of the modification 20 of the image 18, in particular a coordinate of the label 30, with respect to the film spot 24 of the film material 14.

In the punch hole definition step 68 the user can modify the image 18 by marking a position on the image 18, where a punch hole 30 should be affixed to the film material 14. In particular, the interface device 16 draws a circle or a rectangle or another graphical representation for a punch hole 80 into the image 18 in accordance with the user input. The user input may comprise marking a point or a region of the image 18 with a pointer, drag and drop the graphical representation for a punch hole 80 onto the image 18, a numerical input, in particular a desired distance of a punch hole 32' to the film spot 24 or to the film edge of the film material 14 or the like. The position of the graphical representation for a punch hole 80 is extracted from the image 18 by the interface device 16 and forwarded as the processing instruction to a punching station of the packaging machine 12, in particular via the control system 52. The interface device 16 extracts a coordinate of the modification 20 of the image 18, in particular a coordinate of the graphical representation for a punch hole 80, with respect to the film spot 24 of the film material 14.

In the printing definition step 70 the user can modify the image 18 by marking a position on the image 18, where a printing 34' should be imprinted to the film material 14'. In particular, the interface device 16 draws a circle or a rectangle or another graphical representation for a printing 82 into the image 18 in accordance with the user input. The user input may comprise marking a point or a region of the image 18 with a pointer, drag and drop the graphical representation for a printing 82 onto the image 18, a numerical input, in particular a distance of the graphical representation for a printing 82 to the film spot 24 or to the film edge of the film material 14 or the like. The position of the graphical representation for a printing 82 is extracted from the image 18 by the interface device 16 and forwarded as the processing instruction to a printing station of the packaging machine 12, in particular via the control system 52. The interface device 16 extracts a coordinate of the modification 20 of the image 18, in particular a coordinate of the graphical representation for a printing 82, with respect to the film spot 24 of the film material 14. In at least one method step of the method 10 the interface device 16 displays a preview of the film material 14 comprising the image 18 and the modification 20 as interpreted by the interface device 16. If the user agrees to the preview, the interface device 16 stores the modification 20 in the memory of the interface device 16 and/or in the external database.

The interface device 16 preferably retrieves the stored modification 20 form the memory of the interface device 16 and/or the external database and generates the processing instruction based on the modification 20. Alternatively, the processing instruction is generated and stored beforehand in the memory of the interface device 16 and/or the external database, in particular instead or additionally to the modification 20. In the processing stage 72 the interface device 16 preferably forwards the processing instruction to the control systems 52. In the processing stage 72 at least one label 30', at least one punch hole 32' and/or at least one printing 34', that was added as modification 20 to the image 18, is added to the film material 14' by the packaging machine 12, in particular in accordance with the processing instruction generated from the modification 20. The apostrophe on the reference signs indicates, that the segment of the film material 14 shown in the image 18 is in general different from a segment of the film material 14' that is processed by the packaging machine 12. In particular, reference signs with the same number of apostrophes belong to the same segment of film material 14, 14', 14" (cf. FIG. 3). In some cases, in particular in a testing phase of the method 10 and/or the packaging machine 12, the packaging machine 12 processes exactly the segment of the film material 14 that is shown in the image 18.

Figure 3:
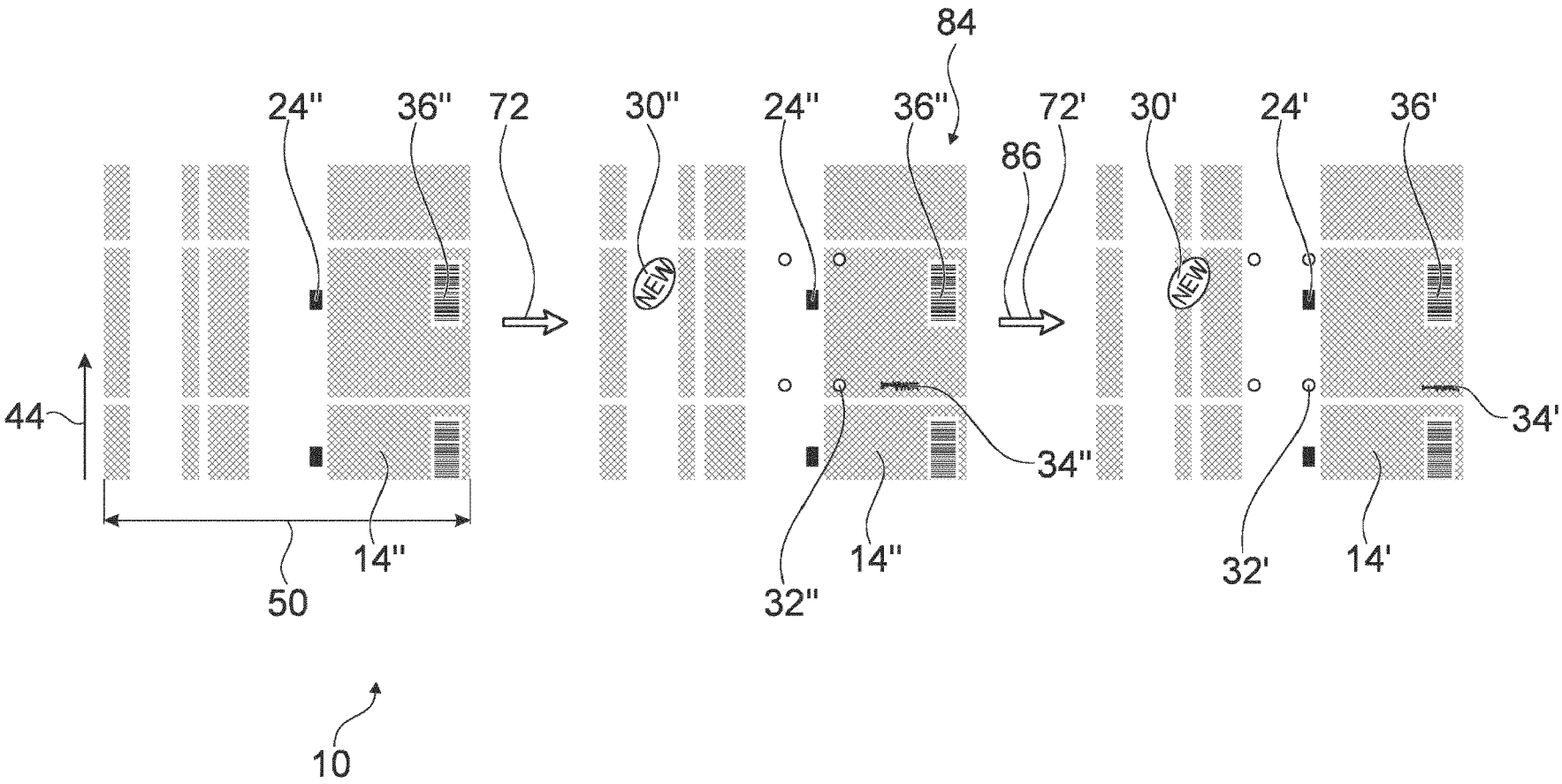

FIG. 3 shows the processing stage 72 of the method 10. In the processing stage 72, the sensor unit 22 reads the identification feature 36" in particular a bar code, of the film material 14", in order to load the image 18 corresponding to the film material 14" from a database, in particular the memory of the interface device 16 and/or the external database. In particular, the control system 52 queries the interface device 16 for the processing instruction that are assigned to the identification feature 36". The interface device preferably searches the database for the identification features 36" and retrieves the according modification 20 and/or processing instruction and forwards the processing instruction to the control system 52.

The packaging machine 12 processes the film material 14" in particular according to the processing instruction. In at least one method step of the method 10 a picture 84 of the at least partly processed film material 14" is compared to the image 18. Preferably the sensor unit 22, in particular one of the line scan cameras 46, 48, takes the picture 84 of the at least partly processed film material 14". The sensor unit 22 and/or the control system 52 sends the picture 84 of the at least partly processed film material 14" preferably to the interface device 16. Optionally the interface device 16 displays the picture 84 in particular together with the image 18. If the picture 84 of the at least partly processed film material 14" deviates from the modified image 18, the interface device 16 preferably outputs a warning to the user and/or generates automatically a correction instruction to the control system 52. In particular, the method 10 comprises a correction step 86, in which the interface sends the manually input or automatically generated correction instruction to the control system 52. For example, the features added to the film material 14", in particular a label 30", punch holes 24" and a printing 34" are shifted in a direction perpendicular to the transportation direction 44 in contrast to where the according modifications 20 made to the image 18 (cf. FIG. 2). Preferably, the correction instruction comprises an instruction to a processing station to relocate and/or reconfigure its processing tool and/or to the guiding unit to relocate the remaining film material 14' within the packaging machine 12. If a manual correction of the packaging machine 12 and or the remaining film material 14' within the packaging machine 12 is necessary, the interface device 16 preferably informs the user about the steps, that are necessary to correct the packaging machine 12 and or the remaining film material 14'. Preferably, after the correction step 86 another processing step 72' is executed to process the remaining film material 14', in which the added features, e.g. a label 30', punch holes 24' and a printing 34', are at the positions indicated by the modification 20 of the image 18.

What is claimed is:

1. A method for operating a packaging machine, wherein in at least one method step the packaging machine processes a film material (14) for forming a container for packing a product therein according to at least one processing instruction, wherein the at least one processing instruction is derived from a user input via an interface device (16) of the packaging machine and wherein the interface device (16) displays an image (18) of the film material, wherein in at least one method step a modification (20) of the displayed image (18) by a user input via the interface device (16) is converted to the at least one processing instruction.

2. The method according to claim 1, wherein in at least one method step the image (18) is taken by a sensor unit (22) of the packaging machine.

3. The method according to claim 1, wherein in at least one method step the image (18) is taken or generated by an external device and uploaded to the packaging machine.

4. The method according to claim 1, wherein in at least one method step the interface device (16) extracts a coordinate of the modification (20) of the image (18) with respect to a film spot (24) of the film material (14).

5. The method according to claim 1, wherein in at least one method step the interface device (16) displays a preview of the film material (14) comprising the image (18) and the modification (20) as interpreted by the interface device (16).

6. The method according to claim 1, wherein in at least one method step a cutting position (26) or a target length (28) added to the image (18) is extracted from the image (18)

and forwarded as the processing instruction to a cutting station of the packaging machine.

7. The method according to claim 1, wherein in at least one method step at least one label (30', 30"), at least one punch hole (32', 32") and/or at least one printing (34', 34") added as modification (20) to the image (18) is added to the film material (14', 14") by the packaging machine.

8. The method according to claim 1, wherein in at least one method step a picture of the at least partly processed film material (14', 14") is compared to the image (18).

9. The method according to claim 1, wherein in at least one method step an identification feature (36) is read, in order to load the image (18) corresponding to the film material (14) from a database.

10. A packaging machine, comprising an interface device (16) to execute a method according to claim 1.

11. The method according to claim 2, wherein in at least one method step the image (18) is taken or generated by an external device and uploaded to the packaging machine.

12. The method according to claim 1, wherein the packaging machine is a form, fill, and seal machine.

13. The method according to claim 9, wherein the identification feature is a bar code of the film material (14).

14. The method according to claim 1, the method further comprising forming the film material into a container and packaging the product within the container.

15. A method for operating a packaging machine, wherein in at least one method step the packaging machine processes a film material (14) for forming a container for packing a product therein according to at least one processing instruction, wherein the at least one processing instruction is derived from a user input via an interface device (16) of the packaging machine and wherein the interface device (16) displays an image (18) of the film material, wherein in at least one method step a modification (20) of the displayed image (18) by a user input via the interface device (16) is converted to the at least one processing instruction, wherein in at least one method step the image (18) is taken or generated by an external device and uploaded to the packaging machine.

16. A method for operating a packaging machine, wherein in at least one method step the packaging machine processes a film material (14) for forming a container for packing a product therein according to at least one processing instruction, wherein the at least one processing instruction is derived from a user input via an interface device (16) of the packaging machine and wherein the interface device (16) displays an image (18) of the film material, wherein in at least one method step a modification (20) of the displayed image (18) by a user input via the interface device (16) is converted to the at least one processing instruction, wherein in at least one method step the interface device (16) displays a preview of the film material (14) comprising the image (18) and the modification (20) as interpreted by the interface device (16).

* * * * *